United States Patent [19]

Arneson

[11] 3,977,518

[45] Aug. 31, 1976

[54] BOTTLE PACKAGE

[75] Inventor: Edwin L. Arneson, Hillsdale, N.J.

[73] Assignee: Federal Paper Board Company, Inc., Montvale, N.J.

[22] Filed: Oct. 14, 1975

[21] Appl. No.: 621,656

Related U.S. Application Data

[63] Continuation-in-part of Ser. No. 582,656, June 2, 1975, abandoned.

[52] U.S. Cl. ..... 206/141; 206/434; 229/28 BC; 229/52 BC; 229/40

[51] Int. Cl.[2] ..... B65D 65/06; B65D 75/04; B65D 5/02

[58] Field of Search ..... 206/140–143, 206/162, 193, 427, 434; 229/28 BC, 40, 52 B, 52 BC, DIG. 6

[56] References Cited

UNITED STATES PATENTS

| | | | |
|---|---|---|---|
| 2,540,065 | 1/1951 | Williamson | 229/40 |
| 3,061,141 | 10/1962 | Cote | 206/140 X |
| 3,104,046 | 9/1963 | Arneson | 206/193 X |
| 3,348,672 | 10/1967 | Brown | 206/140 X |
| 3,593,849 | 7/1971 | Helms et al. | 206/434 X |

*Primary Examiner*—William Price
*Assistant Examiner*—Douglas B. Farrow
*Attorney, Agent, or Firm*—Guy A. Greenawalt

[57] ABSTRACT

A wraparound type carrier package for a group of bottles arranged in row relation and transversely aligned pairs, which carrier is especially adapted for use in the marketing of bottled beverages, wherein the bottles are designed to be returned to the store or bottling plant for reuse or recycling, the package being formed from a flat blank of paperboard or similar foldable sheet material which is cut and scored so that it may be wrapped in the form of an open ended tube about the top and bottom of two rows of bottles in transversely aligned relation with the end margins of the end panels of the blank having co-operating, interengaging locking elements and having means for restraining top and bottom portions of the endmost bottles against movement out of the ends of the tube. A handle structure is provided by a pair of panels which are cut from the center of the material in the top wall forming panel and folded down about a common, transverse fold line into a generally vertical plane, leaving apertures in the top wall forming areas adjoining the handle structure through which bottles in these areas may be removed without otherwise disturbing the package.

8 Claims, 13 Drawing Figures

FIG. 1
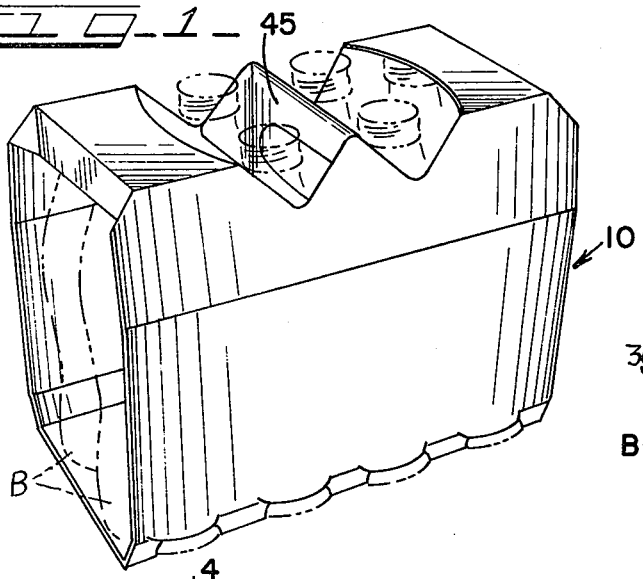
FIG. 2
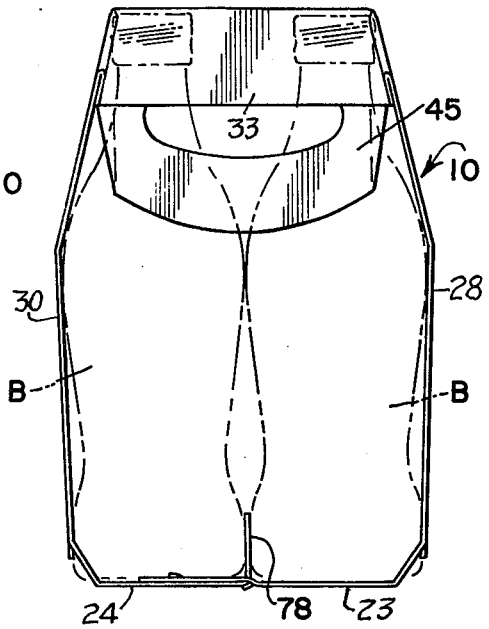
FIG. 3
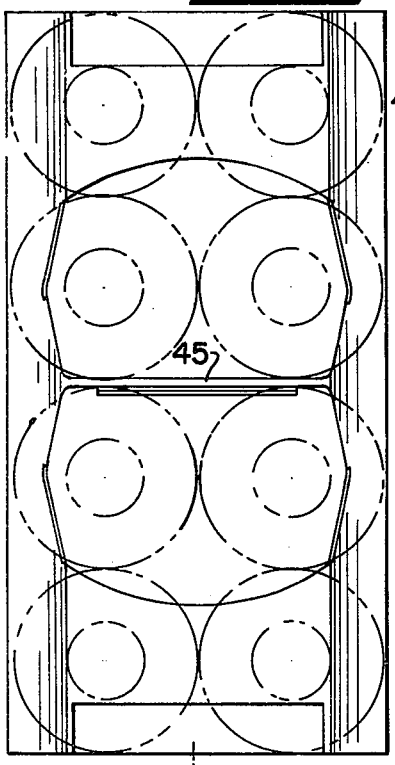
FIG. 4
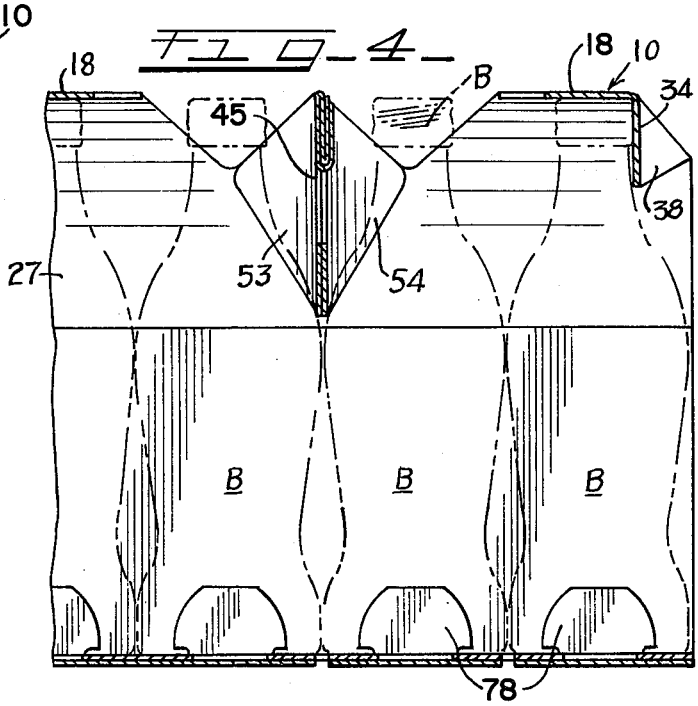
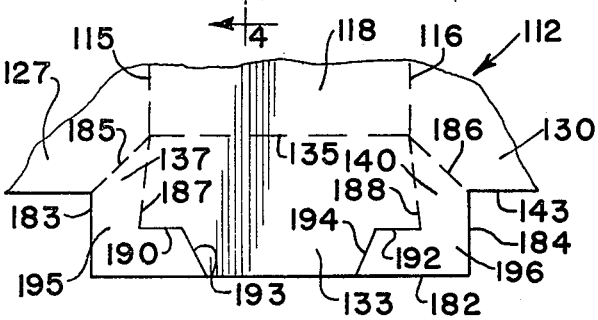
FIG. 6
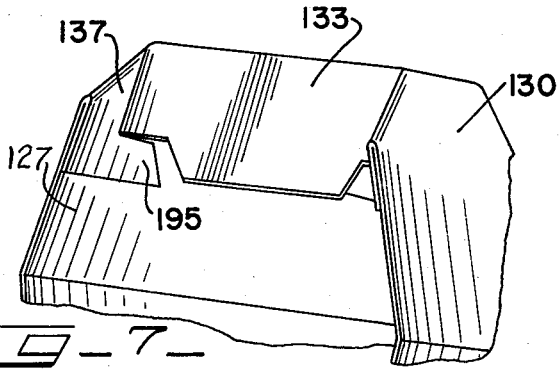
FIG. 7

BOTTLE PACKAGE

This application is a continuation-in-part of application Ser. No. 582,656, filed June 2, 1975, now abandoned.

This invention relates to packaging and is more particularly concerned with improvements in carrier type packages of beverage bottles or similar products which employ a single flat blank wrapped about a group of the bottles arranged in longitudinal and transverse row alignment so as to form a tubular container with provision for confining the bottles at the ends of the container while enabling the bottles to be removed without destroying the carrying capabilities of the container.

In the packaging of bottles and canned beverages two types of carton or carrier structures have achieved extensive use in the beverage marketing industry, namely, the cellular basket-type, which is particularly adaptable for multi-trip use with products in returnable bottles, and the single trip, disposable, wraparound type, which is most often employed with products in non-returnable containers, particularly, canned beverages. With the introduction of the non-returnable or disposable beverage bottles the wraparound type has been adapted for these, also, since it employs less material and is more economical for one-trip, disposable use than the basket type. Initially, the packaging of bottles in a wraparound blank presented a retention problem because of the bottle shape at the top. However, retention apertures in which outside cap edges were seated with provision for a tight wrap solved that problem and the adoption of an "add panel" turned down at the ends of the tube followed. Recently, there has been a demand for elimination of the disposable containers, or alternatively, some arrangement for inducing the consumer to return such containers for reuse or recycling, particularly, the disposable bottles. In response to such demands, it has been suggested that an effort be made to develop a single trip style wraparound style package which will enable the bottles to be removed and replaced without mutilating the wrapper or container to an extent which would render it unfit for the purpose of carrying the empty bottles on a return trip to the distributor. It is a general object of the invention, therefore, to provide a package adapted for marketing bottled products which can be formed by wrapping a blank of paperboard or similar wrapper forming material about a group of bottles in double row and transverse alignment so as to confine the bottles while enabling the customer to readily remove the bottles from the package without destruction of the bottle retaining capabilities of the container and to replace the empty bottles therein for return to the distributor.

A more specific object of the invention is to provide a carrier-type package for marketing bottled beverages or similar products which employs a single blank of paperboard, or similar foldable sheet material, which is cut and scored so that it may be wrapped about a group of bottles which are arranged in double row and transversely paired alignment, with provision for retaining the endmost bottles against movement out of the container thus formed while enabling the bottles to be readily removed without destroying the bottle retaining and carrying characteristics of the wrapper and enabling the bottles, when emptied, to be replaced in the original container for convenience in returning them to the distributor.

Another object of the invention is to provide a wraparound-type bottle package with provision for restraining the endmost bottles against accidental removal from the wrapper while enabling their ready removal and replacement without destroying the container or carton forming characteristics of the wrapper and with a handle construction which extends into the interior of the package between pairs of the bottles and which may remain intact while the bottles are removed and replaced.

To this end the invention as claimed herein is embodied in a package which employs a single blank of paperboard or other suitable foldable sheet or web material which is cut and scored so as to enable it to be wrapped about a group of bottles arranged in double row, transversely paired and longitudinal alignment, with means for retaining the bottles in position in the bottom of the tubular container formed by the wrapper and with means at the top for restraining the endmost bottles against movement out of the ends of the container, together with a handle structure in the form of a pair of panels cut in part from the top wall and in part from the side walls and folded down into a vertical plane in the interior of the tubular carrying container or carton and between oppositely disposed top portions of transversely aligned pairs of the bottles, enabling the bottles to be readily removed and replaced in the carrying container without material damage to the container and without destroying the carrying capabilities of the same.

The aforesaid objects and other objects and advantages of the invention will become more apparent when reference is made to the accompanying detailed description of the preferred embodiments of the invention which are set forth therein, by way of example, and shown in the accompanying drawings wherein like reference numerals indicate corresponding parts throughout.

FIG. 1 is a perspective view of a set-up bottle carrier type container, with bottles shown therein in phantom line, which embodies the principles of the invention;

FIG. 2 is an end view of the container of FIG. 1, to a larger scale;

FIG. 3 is a top plan view of the container of FIG. 1, to a larger scale;

FIG. 4 is a partial longitudinal section taken on the line 4—4 of FIG. 3;

FIG. 6 is a fragmentary plan view showing a portion of a modified blank structure;

FIG. 7 is a fragmentary perspective view showing a portion of an end of a carrier container formed with the modified blank of FIG. 6;

Figure 5:
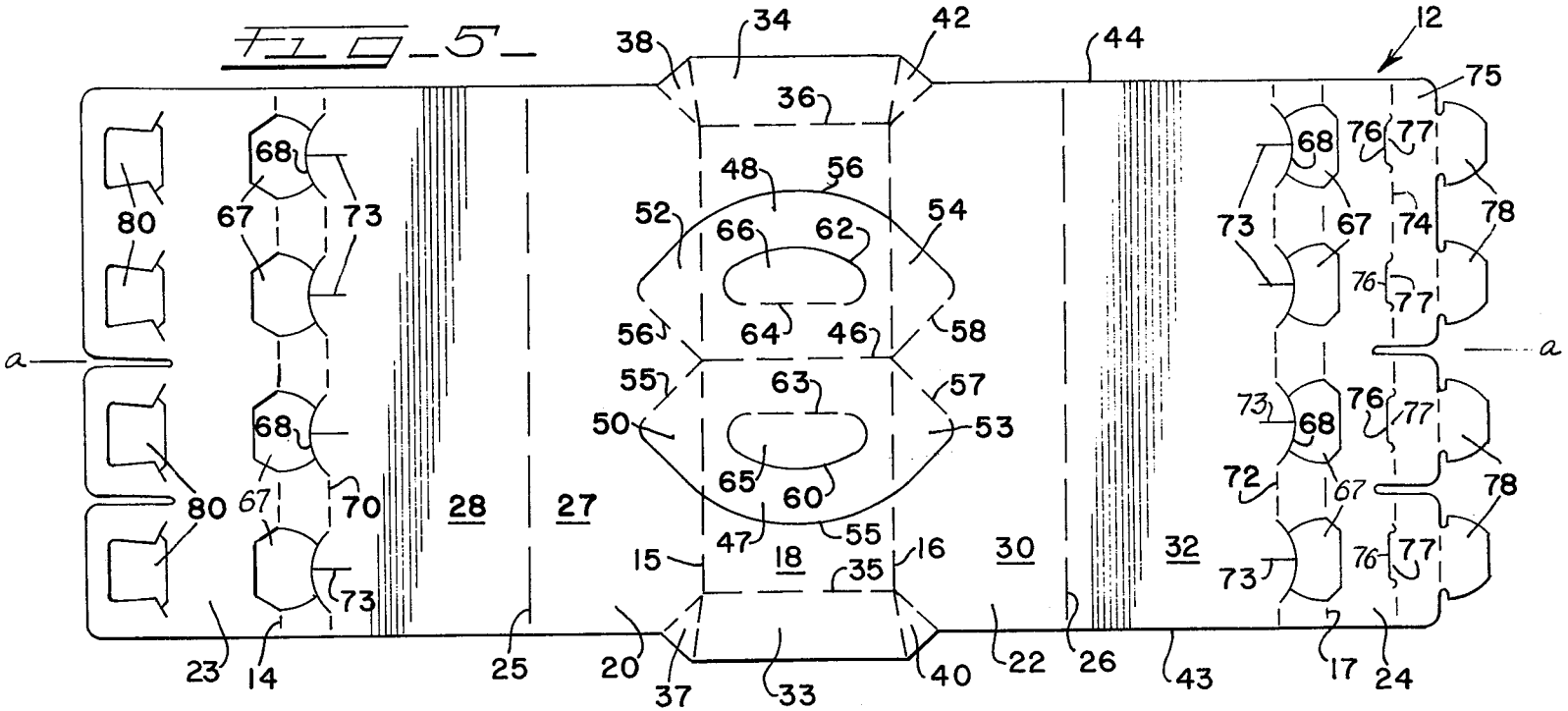
FIG. 5 is a plan view of a cut and scored blank for wrapping about a cluster of bottles to form the container and package illustrated in FIG. 1.

Referring to the drawings, there is illustrated a carrier carton for an eight bottle package and a cut and scored blank of paperboard, or similar foldable sheet material, for making the same, which embodies the principal features of the invention, and several modifications thereof. It will be understood that the principles of the invention may be otherwise applied and that the following description of the carrier carton and the modified carton structure as shown in the drawings is for the purpose of setting forth the several forms of the invention which are presently preferred.

The carton structure 10 which is illustrated in FIGS. 1 to 4 is formed by wrapping the blank 12 of FIG. 5 about a cluster of beverage bottles B which are arranged in two rows of four bottles each with the bottles in transversely paired alignment. The blank 12 is paperboard or other suitable foldable sheet material which is cut and scored as shown in FIG. 5. The blank 12, which is symmetrical about a longitudinally extending center line *a—a*, is divided by parallel, longitudinally spaced score lines 14, 15, 16 and 17, which extend transversely of the blank, into a top wall forming center panel section 18, adjoining side wall forming panel sections 20 and 22 and bottom wall forming panel sections 23 and 24, the last mentioned being at opposite end margins of the blank 12. The side wall forming panel sections 20 and 22 are subdivided by transversely extending score lines 25 and 26, which are parallel with and equally spaced from the score lines 15 and 16, into associated top and bottom side wall forming panels 27, 28 and 30, 32, respectively. The dimension of the top wall forming panel section 18 in the direction longitudinally of the blank corresponds approximately to the distance between the outside edges of the capped tops of a pair of transversely aligned bottles B, which distance is less than the transverse distance at the bottom of the bottles with the result that the top side wall panels 27 and 30 are slanted toward each other when the wrapper is assembled about a group of bottles, the score lines 25 and 26 being located so that the panels 27 and 30 follow generally or generally conform to the upward slant of the bottle surfaces at the upper portions of the bottles, that is, the portions extending from the main portion of the bottle body to the neck portion thereof. The dimensions, longitudinally of the blank, of the bottom side wall portions 28, 32 correspond generally to the height of the main body portions of the bottles B. The width or transverse dimension of the major portion of the blank 12 corresponds approximately to the bottom dimension of the rows of bottles B, when grouped as shown in FIG. 3, so that when the wrapper 12 is wrapped about the group of bottles, it takes the form of an open ended tube with provision for restraining the bottles against removal out of the ends of the tube.

The restraining means for the top of the endmost bottles comprises relatively narrow panels 33 and 34 formed in opposite side margins of the blank 12 and extending from the opposite ends of the top wall forming panel 18. The panels 33 and 34 are separated from the panel 18 by longitudinally extending hinge or fold forming score lines 35 and 36 with the opposite ends of the panels joined to the adjoining side wall panels 27 and 30 by foldable, triangular webs 37, 38 and 40, 42 which in the set-up carton or carrier are folded so as to lie on the inside surfaces of the side wall forming panels, as shown in FIGS. 1, 2 and 4. The top end wall panels 33 and 34 project a short distance beyond the longitudinally extending side edges 43 and 44 of the blank 12 and extend inwardly thereof a similar distance to the score lines 35 and 36, as viewed in FIG. 5.

The top wall forming panel 18 and the adjoining side wall panels 27 and 30 are cut and scored to provide a handle forming structure 45 (FIGS. 1 to 4) when the package is formed. A score line 46, extending longitudinally of the blank and centered transversely thereof, is adapted to form a hinge fold for a pair of handle forming panels 47 and 48 which extend on opposite sides of the score line 46 and are cut primarily from the material in the panel 18 with end portions 50, 52 and 53, 54 extending into the adjoining side wall panels 27 and 30. The handle panels 47 and 48 are formed by cutting on the curved lines 55 and 56 which are equally spaced laterally from the center score line 46, which are semi-circular or bowed outwardly toward the blank side edges, in the form illustrated, and which extend at the ends into the side wall forming panels 27 and 30 to the ends of pairs of score lines 55, 56 and 57, 58. The score lines 55, 56 and 57, 58 extend in diverging relation from the intersection of the score line 46 with the transverse score lines 15 and 16 and are adapted to serve as hinge folds for the handle panel end portions 50, 52 and 53, 54 which constitute triangular web formations connecting the handle panels to the side wall panels 27 and 30 at opposite ends of the panels 47 and 48 when the panels 47 and 48 are folded into a vertical plane within the carton or carrier so as to form the handle structure 45 as shown in FIG. 4. The handle panels 47 and 48 are provided with aligned finger apertures by cutting on the curved lines 60, 62 and scoring on the hinge forming lines 63, 64 thereby providing small reinforcing panels or tabs 65 and 66 which are adapted to fold or hinge on the lines 63, 64 to the position shown in FIG. 4 or to a position sandwiched between the folded panels 47 and 48.

The side wall forming panels 28 and 32 are provided with a series of transversely spaced apertures 67 of identical configuration which are spaced transversely of the blank in accordance with the spacing of the bottles in the lengthwise rows. The apertures 67 interrupt the bottom fold or hinge forming score lines 14 and 17 and extend a short distance into the bottom wall forming panels 23 and 24. The uppermost edges of the apertures 67 in the set up carton are defined by curved cutting lines 68 which bulge or bow into the apertures 67 and which have their ends connected by transverse fold lines 70 and 72. The latter are spaced toward the center of the blank from the fold lines 14 and 17 and the small side wall sections or tabs thus formed are split by short, longitudinally extending cuts 73. The apertures 67 are adapted to receive the heels of the bottles so as to hold the bottles at the bottom against movement in the tightly wrapped package 10. The apertures 67 and associated elements may be formed in accordance with the disclosure in U.S. Pat. No. 3,589,593, granted to Arthur J. Weiss, on June 29, 1971.

The bottom wall forming panels 23 and 24 at the end margins of the blank 12 are provided with locking and latching means in the free marginal portions which are adapted to be overlapped and secured beneath the bottom of the bottle assembly in wrapping the blank about the assembly so as to form the package 10. The panel 24 which is outermost, when the panels 23 and 24 are overlapped to form the carrier bottom, is scored on a transverse line 74 to provide a relatively narrow male locking panel 75 on the blank end margin. The score line 74 is spaced from the end edge of the blank and is interrupted by a series of transversely spaced cutting line formations 76 each extending into the main body of the panel 24 so as to provide locking tab members 77. A series of latching fingers 78, having enlarged heads and reduced neck portions, are formed on the blank end margin in alignment with the locking tab members 77. The locking panel 75 may be sectionalized, as shown, to facilitate manipulation in the locking operations. The other bottom wall forming panel 23, which may be termed the female locking panel, is provided along its free margin with a series of locking apertures 80 for receiving the locking tabs 77 and the latching fingers 78. The locking apertures 80 are transversely spaced in accordance with the spacing of the locking and latching elements 77 and 78 so as to cooperate therewith in securing the panels 23 and 24. The locking and latching arrangement may be the same as the corresponding arrangement described in aforesaid patent No. 3,589,593 or as described in U.S. Pat. No. 3,556,386 granted to Robert H. Ganz, on Jan. 19, 1971.

The manner in which the cut and scored blank 12 is applied to the group or assembly of bottles B will be readily apparent from the drawings and the foregoing description. The blanks are designed to be fed down over the top surfaces of the bottle clusters or assemblies with the handle panels 47 and 48 turned down toward a vertical center plane so as to lie between the center pairs of transversely aligned bottles and leaving openings in the top panel 18 which provide access to the center pairs of bottles. The side wall panels 27, 28 and 30, 32 are folded down along the outermost side surfaces of the bottles and the bottom wall forming panels 23 and 24 are overlapped with the locking tabs 77 and latching fingers 78 being engaged in the apertures 80 while tightly drawn to confine the bottles. The latch forming fingers 78 are positioned in a vertical plane, as shown in FIG. 2, so as to serve as separators for the bottom portions of the transversely aligned pairs of bottles. The bottom or outside heel portions of the bottles are seated in the apertures 67. The panels 33 and 34 are turned down into a generally vertical plane so as to confine the end pairs of bottles at the tops thereof. These panels 33 and 34 may serve as advertising elements and they may be hinged outward without destruction so as to release the tops of the end pairs of bottles for removal and subsequent replacement. When the bottles are replaced the panels 33 and 34 may be hinged to bottle restraining position without destruction of the web members 37, 40 and 38, 42 which retain them in such position. Appropriate instructions for removing and replacing the bottles may be printed on the carton surface. The consumer is able to discern, generally without instructions, that the bottles may be readily removed and replaced without destroying the carton and the handle arrangement alerts him to the reuse capability for returning the bottles to the distributor.

In FIGS. 6 and 7 there is illustrated a modified form of restraining means for the end pair of bottles in the carrier package. Only one of the modified end panel arrangements is shown, it being understood that a corresponding arrangement is provided at the other side of the blank 112 (FIG. 6). The blank 112 is scored to provide the top wall forming panel 118, the same as in the blank 12 of FIG. 5, with longitudinally spaced, transverse score lines 115 and 116 defining side edges of the panel 118 and the end wall forming panel 133 separated therefrom by the longitudinally extending score line 135. The score line 135 is offset inwardly of the side edge 143 of the blank and a rectangular portion of the panel 133 projects outwardly of the blank side edge 143 and is defined by an outer side edge 182 and transverse edges 183 and 184 which are spaced longitudinally of the blank and offset from the plane of the transverse score lines 115 and 116 in the direction of the ends of the blank 112. Hinge forming score lines 185 and 186 extend from the intersection of the score line 135 with the transverse score lines 115 and 116, in diverging relation, to the intersections of the edge lines 183 and 184 with the blank side edge 143, and define a hinge side of web formations 137 and 140 which connect the panel 133 with side wall forming panel portions 127 and 130. The other hinge side is defined by score lines 187 and 188 diverging outwardly from the ends of the transverse score lines 115 and 116. The score lines 187 and 188 extend to relatively short, longitudinally extending cutting lines 190 and 192 which extend toward each other to a pair of cutting lines 193 and 194, which, in turn, extend to the side edge 182, resulting in reinforcing extensions 195 and 196 on the web formations 137 and 140, which will lie along the side wall panels 127 and 130 in the set up condition of the carrier, as shown in FIG. 7, while providing a somewhat deeper end panel 133.

Figure 9:
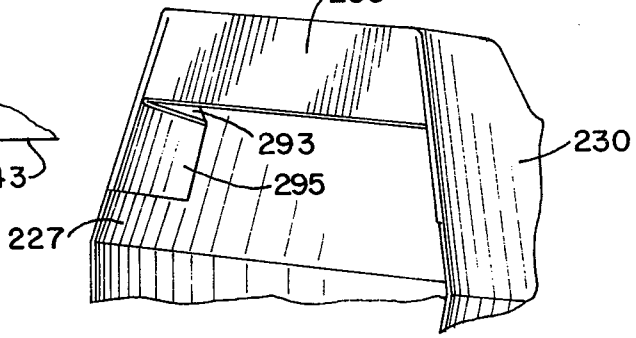
FIG. 9 is a fragmentary perspective view showing a top portion of one end of a carrier container formed with the blank of FIG. 8.
Figure 8:
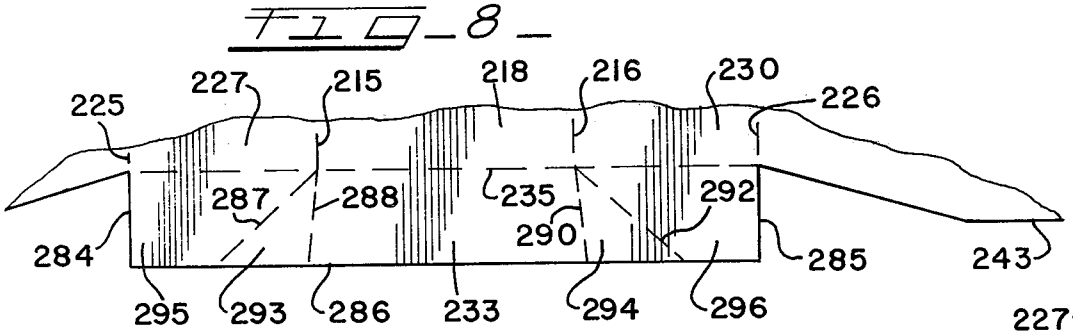
FIG. 8 is a fragmentary plan view of a further modified blank structure.

Another top end wall panel arrangement is illustrated in FIGS. 8 and 9. The top wall panel 218 is formed in the blank 212 in the same manner by spaced, transverse scores 215 and 216 and the end wall panel 233 is separated from the panel 218 by longitudinal score line 235 which extends a substantial distance towards opposite ends of the blank 212 and defines portions of the ends of the top panel portions 227 and 230 of the side wall panel sections, terminating at the inner ends of diagonal cutting lines 282 and 283 extending from the blank side edge 243 to points adjacent the ends of the transverse score lines. Transverse cutting lines 284 and 285 extend from the ends of the longitudinal score line 235 which form the ends of the panel 233, the outer edge 286 of the latter being offset outwardly of the plane of the blank edge 243. Pairs of diverging score lines 287, 288 and 290, 292 extend from the intersections of the line 235 with the transverse score lines 215 and 216 to the outer side edge 286 of the panel 233 and define triangular web formations 293, 294 and 295, 296 which are adapted to fold on each other and lie on the inside faces of the side wall panels 227 and 230 as shown in FIG. 9 so as to reinforce the connections between the end wall panel 233 and the side wall panels.

Figure 11:
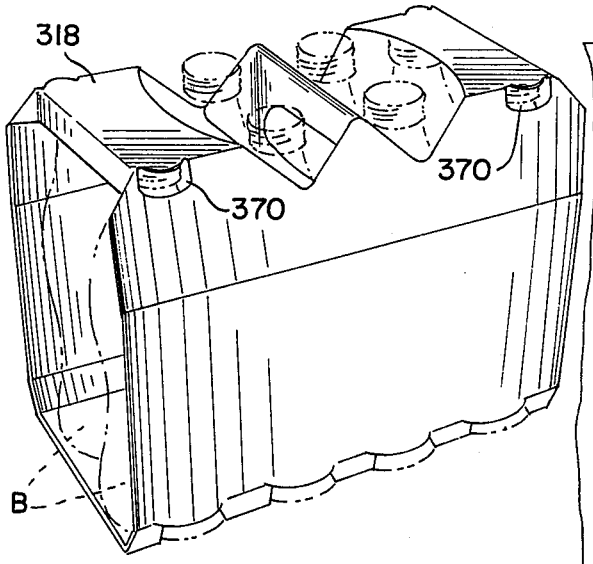
FIG. 11 is a perspective view showing a bottle package formed with the modified blank of FIG. 10.
Figure 10:
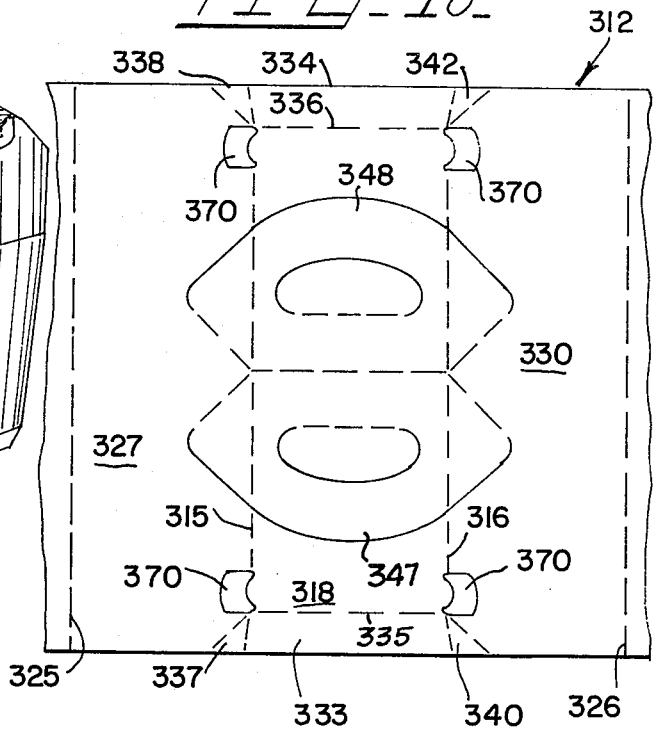
FIG. 10 is a partial plan view showing a central portion of a cut and scored blank for wrapping about a cluster of bottles to form a further modified bottle package.

In FIGS. 10 and 11 another form of the carrier package or carton having a modified top wall forming panel arrangement is illustrated. In this form of the carrier the blank 312 is cut and scored as described with respect to blank 12 except for the top wall forming panel 318 and adjoining side wall panel portions 327 and 330. The top wall panel 318 is defined in the blank 312 by spaced, parallel, transverse score lines 315 and 316 while the adjoining top side wall forming panels 327 and 330 extend between the score lines 315 and 316 and the transversely extending, parallel score lines 325 and 326 which are spaced from the score lines 315 and 316, respectively. Handle forming panels 347 and 348 are formed in these panels in the same manner as the handle panels 47 and 48 in the blank of FIG. 5. Score lines 335 and 336 are spaced inwardly of the side edges of the blank and extend between the transverse score lines 315 and 316 so as to define fold lines for add panel formations 333 and 334 which are connected to top corner portions of the top side wall forming panels 327 and 330 by triangular web formations 337, 340 and 338, 342. The distance between the score lines 315 and 316 is somewhat less than the distance between the outside edges of the bottle caps of the aligned pairs of endmost bottles and cap receiving apertures 370 are provided in the side wall panels which are located so that the caps on the endmost bottles seat therein when the blank is wrapped about the bottles. The blank 312 is assembled with a cluster of bottles B and wrapped about the bottles in the same manner as described with respect to the blank 12, with possible somewhat less tension or compression when the panels are locked together, so that the apertures 370 will serve to restrain the endmost bottles against movement out of the ends of the carrier while at the same time the end bottles may be intentionally removed without destroying the retention capabilities of the wrapper. In this form the add panel serves its normal function and is not relied upon to hold the end bottles in the carrier.

Figure 13:
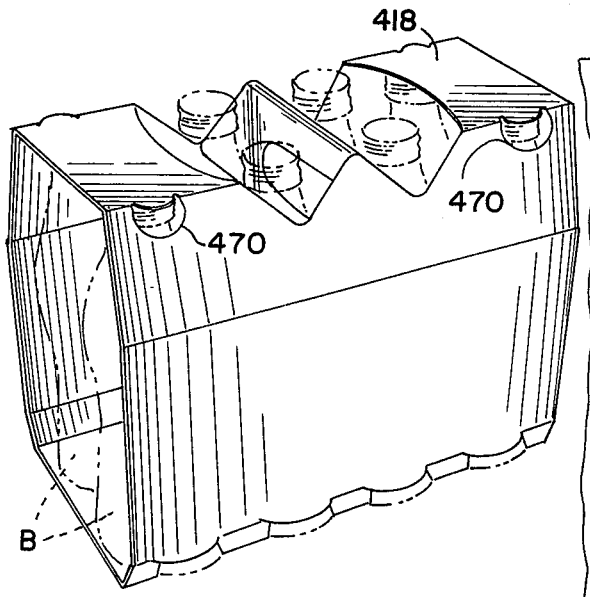
FIG. 13 is a perspective view showing a bottle package formed with the modified blank of FIG. 12.
Figure 12:
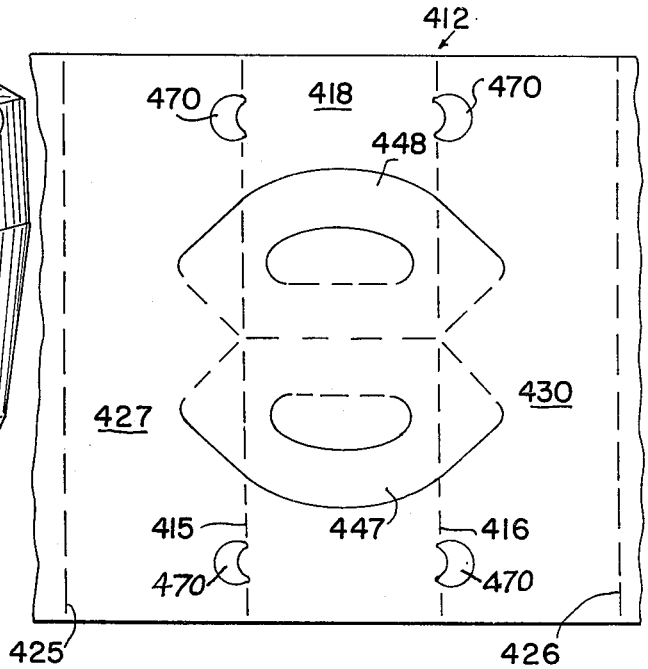
FIG. 12 is a partial plan view showing a central portion of a cut and scored blank for wrapping about a cluster of bottles to form a still further modified bottle package.

Still another modified form of the carrier is illustrated in FIGS. 12 and 13. The blank 412 is cut and scored in the same manner as described with respect to the blank 12 except for the omission of the add panel formations 33, 34 and the provision of cap receiving apertures 470 in the side wall panel portions 427 and 430. The top wall forming panel 418 is defined by the spaced transverse score lines 415 and 416 while the adjoining top side wall forming panels 427 and 430 are defined by the spaced parallel score lines 425, 415 and 426, 416. Apertures 470 are provided in the side wall forming panels 427 and 430 adjacent the score lines 415 and 416 in which the caps on the endmost bottles are seated when the blank is wrapped about a cluster of bottles so as to serve as a means for restraining the endmost bottles against accidental movement out of the ends of the carrier while permitting intentional removal without the need for tearing the blank material. Handle panels 447 and 448 are formed in the blank 412 in the same manner as the handle panels 47 and 48 in the blank 12 and are folded to form handle members in the same way.

In all forms of the carrier or carton which are disclosed the handle structure is the same. In each form the handle panels depend from the plane of the top wall forming panel so that they nest between the center pairs of bottles. The center pairs of bottles may be readily removed upwardly through the openings resulting from the handle panel formation. With the exercise of a normal degree of care the endmost bottles may be removed without appreciable tearing of the blank and without destroying the retention capability of the carton so that the empty bottles may be replaced for a return trip to the distribution center.

I claim:

1. In a wraparound type package for a group of bottles or the like arranged in double row relation and in transversely aligned pairs, a tubular container formed from a blank of foldable sheet material which is wrapped about the top, opposite sides and bottom of said group of bottles, said container comprising a top wall forming panel disposed on the top of the bottles, adjoining side wall forming panels extending along the outermost sides of the bottles in the two rows, and co-operating bottom wall forming panels folded beneath the bottles, which bottom wall forming panels have overlapped marginal portions with interengaging locking elements connecting said panels, means for restraining the bottles at the bottom thereof against movement out of the ends of the tubular container, means at the opposite ends of the top wall forming panel for restraining the endmost bottles against movement out of the ends of the container, and a handle forming structure extending in a vertical transverse plane which comprises panels cut in part from the top wall forming panel and disposed in downwardly folded relation from a transverse hinge line in the plane of the top wall forming panel, said handle panels being positioned between center pairs of bottles, and said handle panels having opposite end portions which are connected to the adjoining side wall forming panels by triangular web members and which are provided with finger accommodating apertures.

2. A carton for a package comprising an assembly of articles in the form of bottles which are arranged in double row, transversely aligned pairs and enclosed in said carton, said carton being in the form of a tube of foldable sheet material with connected wall forming panels which are disposed about the top, sides and bottom of the articles when the assembly of articles is enclosed in said carton, said carton having side and bottom wall forming panels with means for restraining the articles at the bottom against movement out of the ends of the carton, said carton having a top wall forming panel with means at the opposite ends to restrain top portions of the endmost articles against endwise displacement and a pair of handle panels which are taken from a center portion of said top wall forming panel and which depend from a transverse hinge line so as to extend downwardly between transversely aligned pairs of the articles which are disposed in the areas adjoining said handle panels, said handle panels co-operating in forming a handle structure depending in a plane extending transversely of the carton and enabling removal and replacement of the articles without destruction of the article restraining and carrying capabilities of the carton.

3. A carton for a package as set forth in claim 2 wherein said handle forming panels are disposed in face engagement in a common vertical plane extending between said pairs of articles in said areas adjoining said panels, and said handle forming panels depending below the plane of said top wall forming panel and being provided with finger accommodating, aligned apertures.

4. A carton for a package as set forth in claim 3 wherein said handle forming panels are connected at opposite ends thereof to top portions of the side wall panels by triangular web portions which are hinged to said handle forming panels and to said side wall forming panels.

5. A carton for a package as set forth in claim 2 wherein said handle forming panels are connected at opposite ends thereof to portions of the side wall panels by foldable web portions which are defined by co-operating pairs of hinge lines extending in diverging relation from opposite ends of said transverse hinge line from which said handle forming panels.

6. A carton for a package as set forth in claim 2 wherein said handle panels are cut in said top wall forming panel on generally C-shaped lines disposed on opposite sides of said transverse hinge line and curving outwardly in the direction of the outer end edges of said top wall forming panel and extending from said transverse hinge line a sufficient distance to provide openings in said top wall forming panel of a size sufficient to enable removal upwardly therethrough of the pairs of articles between which the handle panels extend.

7. A carton for a package as set forth in claim 2 wherein said hingedly connected end extensions of said top wall forming panel depend from hinge lines spaced inwardly of the end edges of adjoining side wall forming panels and said end extensions are connected to said adjoining side wall forming panels by foldable web portions with extensions on said web portions which lie along the inside faces of said side wall forming panels and which reinforce the connection between said end extensions and said side wall forming panels.

8. A carton for a package as set forth in claim 2 wherein said hingedly connected end extensions of said top wall forming panel depend from hinge lines offset inwardly of bottom edge portions of the adjoining side wall panels so as to form narrow end closure panels, said ajoining side wall panels having end extensions hinged on extensions of said offset hinge lines and connected to said end closure panels by foldable triangular web portions whereby said side wall panel extensions lie along the top portions of the inside faces of the top side wall portions and extend downwardly along the same a substantial distance thereby reinforcing the hinge connections between said end closure panels and said side wall forming panels.

* * * * *